United States Patent [19]

Johnson

[11] Patent Number: 4,469,980

[45] Date of Patent: Sep. 4, 1984

[54] FLUORESCENT LAMP WITH NON-SCATTERING PHOSPHOR

[75] Inventor: Peter D. Johnson, Schenectady, N.Y.

[73] Assignee: General Electric Company, Schenectady, N.Y.

[21] Appl. No.: 332,710

[22] Filed: Dec. 21, 1981

[51] Int. Cl.[3] ..... H01J 61/44

[52] U.S. Cl. ..... 313/25; 313/486; 313/493; 313/116

[58] Field of Search ..... 313/485, 487, 116, 25, 313/493, 486; 362/260, 84

[56] References Cited

U.S. PATENT DOCUMENTS

| | | | |
|---|---|---|---|
| 2,030,440 | 2/1936 | Fritze et al. | 313/485 X |
| 2,213,245 | 9/1940 | Germer | 362/84 X |
| 2,713,629 | 7/1955 | Etzkorn | 362/84 |
| 2,905,863 | 9/1959 | Martin et al. | 362/84 X |
| 3,492,105 | 1/1970 | Pfaender | 313/485 X |
| 3,504,819 | 4/1970 | Veres | 313/485 X |
| 3,892,997 | 7/1975 | Thorington et al. | 313/487 |
| 4,001,628 | 1/1977 | Ryan | 313/487 |
| 4,171,498 | 10/1979 | Fromm et al. | 313/485 X |
| 4,315,193 | 2/1982 | Thornton | 313/487 |

FOREIGN PATENT DOCUMENTS

| | | | |
|---|---|---|---|
| 2311991 | 12/1976 | France | 362/84 |

*Primary Examiner*—Palmer C. Demeo

*Attorney, Agent, or Firm*—Mark L. Mollon; James C. Davis, Jr.; M. Snyder

[57] ABSTRACT

A fluorescent lamp comprises a source of near ultraviolet radiation together with an outer shell at least partially surrounding the ultraviolet source and comprising an ultraviolet transmissive material, the shell having embedded or dissolved therein a phosphor material having an indexed refraction approximately, but not quite equal, to the index of refraction of the shell.

3 Claims, 3 Drawing Figures

FLUORESCENT LAMP WITH NON-SCATTERING PHOSPHOR

BACKGROUND OF THE DISCLOSURE

The present invention relates to fluorescent lamps and, more particularly, to fluorescent lamps employing near ultraviolet radiation sources together with phosphor material which is index matched to an outer envelope.

In conventional fluorescent lamps, most of the visible light output originates in a thin layer of phosphor which is disposed immediately adjacent to a mercury discharge. This fact is a consequence of the high optical absorption coefficients that most phosphors exhibit at the 254 nanometer wavelength of mercury resonance radiation in the far ultraviolet spectral region. Since much of this light is directed back into the lamp be scattering, useful light output is lost by multiple scattering within the outer portion of the phosphor material and by absorption at the ends of the lamp.

It would be desirable to minimize this visible light scattering loss by optimizing the scattering characteristics of the phosphor for escape of the visible length radiation from the lamp. However, in conventional lamps where the excitation occurs as a result of the mercury resonance radiation at 254 nanometers, it is not possible to imbed phosphors in a suitable optimizing matrix since no low melting point material which is transparent to this short wavelength radiation is available.

However, in U.S. patent application Ser. No. 288,822, filed July 31, 1981, there is disclosed a compact fluorescent lamp with copper arc excitation. The lamp disclosed therein is an efficient producer of near ultraviolet radiation. For example, if a copper halide is used in the ionizing discharge medium, ultraviolet radiation at 324.7 and 327.4 nanometers is produced. It is the use of a practical, near ultraviolet source for phosphor excitation which makes possible the consideration of employing materials, particularly plastic materials and low melting point glasses, in which a phosphor may be embedded to optimize optical properties. More particularly, the present invention discloses a fluorescent lamp in which the phosphor and embedding matrix material comprises substances which are matched to one another with respect to their indices of refraction or in which an optically homogeneous solution of phosphor and matrix is employed.

It is noted, however, that the use of phosphor materials embedded in a light-transmissive matrix which is matched to the phosphor in terms of their respective indices of refraction has been employed in the past in significantly different applications. In particular, the use of such phosphors in index matched plastic material has been proposed as a substitute for certain crystal X-ray detecting phosphor bodies. However, consideration of such materials in fluorescent lamps was not possible until the development of the fluorescent lamp described in above-mentioned application Ser. No. 288,822, submitted in behalf of the same inventor as herein, and assigned to the same assignee as herein. Accordingly, the above-described patent application is hereby incorporated herein by reference.

In short, since conventional fluorescent lamps employ a mercury resonance radiation at the far ultraviolet region of the sprctrum, around 254 nanometers, it has not been possible to dispose the phosphor within a matrix medium since no low melting point material transparent to such short wavelength radiation was available. Furthermore, even though phosphors have been index matched to matrix media in the past, for the purposes of applications such as X-ray detection, index matching of fluorescent lamp phosphors was not generally thought to be available because of the lack of a suitable matrix material which was transparent to far ultraviolet radiation. However, a newly-developed, practical fluorescent lamp producing ultraviolet radiation in the near ultraviolet range has now made it possible to consider embedding phosphor materials in a matrix medium which is transparent to the near ultraviolet radiation.

SUMMARY OF THE INVENTION

In accordance with a preferred embodiment of the present invention, a fluorescent lamp comprises a source of near ultraviolet radiation having a wavelength between approximately 280 and approximately 400 nanometers together with a shell at least partially surrounding the ultraviolet source. The shell comprises a material transmissive to ultraviolet radiation in the above-mentioned range and transmissive to visible length radiation, the shell having embedded therein a phosphor material having an index of refraction approximately equal to the index of refraction of the shell material. In one embodiment of the present invention, the outer surface of the shell is provided with an irregular texture as by roughing, etching, molding, grinding, machining, or casting so as to enhance the escape of visible light. In still another embodiment of the present invention, the shell or outer envelope is plastic and the phosphors are organic phosphors which are dissolved within the plastic material.

Accordingly, an object of the present invention is to provide a more efficient fluorescent lamp.

It is also an object of the present invention to optimize the amount of visible wavelength radiation emitted from a fluorescent lamp.

Additionally, it is an object of the present invention to provide a fluorescent lamp having excitation in the near ultraviolet region.

DESCRIPTION OF THE FIGURES

The subject matter which is regarded as the invention is particularly pointed out and distinctly claimed in the concluding portion of the specification. The invention, however, both as to organization and method of practice, together with further objects and advantages thereof, may best be understood by reference to the following description taken in connection with the accompanying drawings in which:

DETAILED DESCRIPTION OF THE INVENTION

Figures 1, 2, 3:
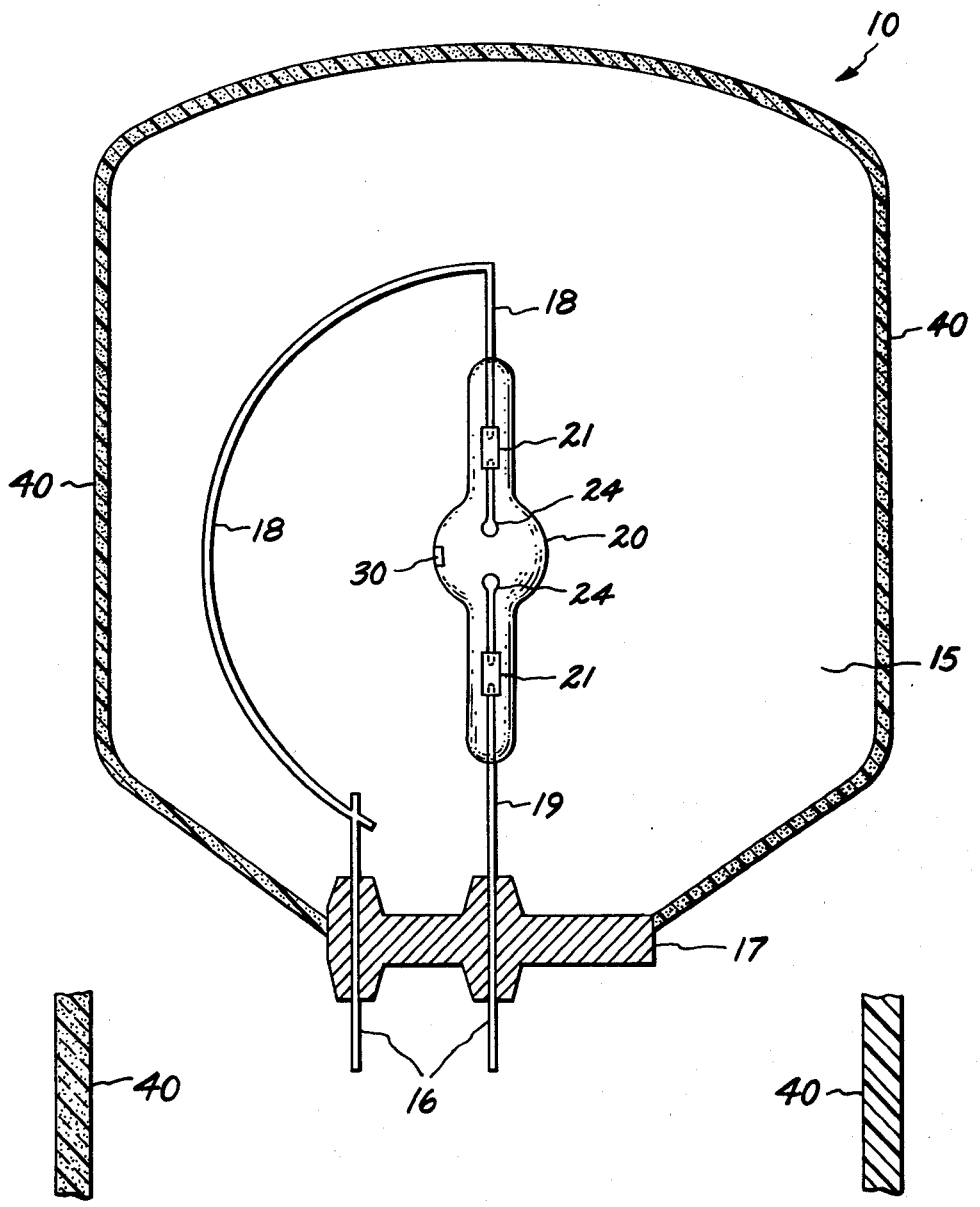
FIG. 1 is a partial cross-sectional side elevation view of a fluorescent lamp having a near ultraviolet radiation source together with a phosphor material disposed within an outer shell or envelope.
FIG. 2 is a side elevation, cross-sectional view of a portion of the outer envelope illustrating that it may comprise phosphor embedded in glass.
FIG. 3 is a side elevation, cross-sectional view of a portion of the outer envelope illustrating that it may comprise a solution of organic phosphor.

FIG. 1 illustrates one embodiment of the present invention in which outer jacket or shell 40 and arc tube 20 are configured in the general size and shape of a lamp envelope which serves as a replacement for conventional incandescent lamps. However, the lamp of the present invention may assume a large range of sizes and shapes. Furthermore, electronic ballast means are not illustrated, since they are not part of the present invention. However, conventional electronic or other ballast means are typically employed in such lamps. In the Figure, lamp 10 is seen to possess outer jacket or envelope 40 having phosphor particles or material disposed therein. Exterior envelope 40 is preferably gas-tight and is transmissive to light at visible wavelengths. Outer shell 40 may be conveniently fastened to glass base 17 through which leads 16 are disposed. Shell 40 surrounds arc tube 20, which is more particularly described and discussed below. Arc tube 20 is a source of radiation at specific ultraviolet wavelengths and may comprise either relatively hard or relatively soft glass depending upon the operating temperature of the lamp. Arc tube 20 is supported within shell 40 by means of stiff electrode leads 18 and 19 as shown. Leads 18 and 19 are also electrically and mechanically connected to leads 16, which pass through base 17. Base 17 also serves as a stable platform for mounting arc tube 20 within shell 40. As is conventionally known in the art, electrodes 16 typically comprise or are coated with a metal composition to which the glass in base 17 is particularly adherent. In this way, the gas-tight integrity of outer shell 40 may be maintained. As is also well known in the lamp arts, electrodes 16 are coupled in a conventional manner to an appropriate electronic ballast which operates to supply starting and running voltage for the lamp.

A number of phosphors may be embedded in shell 40. The principal requirement for these phosphors is that they absorb radiation in the near ultraviolet region and reradiate visible wavelength radiation. For example, but without limitation, these phosphors may include compounds such as yttrium vanadate doped with europium, zinc silicate germanate doped with manganese, and magnesium germanate doped with manganese. Organic phosphors which may be dissolved in shell 40, particularly if it comprises plastic, include, but are not limited to: perylene, chrysene, fluorescein, rhodamine, ethylviolet and malchite green.

Space 15 between arc tube 20 and outer shell 40 preferably comprises a vacuum for the above-described inorganic phosphor materials. A vacuum is also preferred whenever the phosphor employed is one which is most efficient when operating at or near room temperature. In other embodiments of the invention in which the phosphor employed exhibits a higher efficiency at elevated temperatures, space 15 preferably includes inert gas such as nitrogen or argon so that some convective and/or conductive heat flow may be provided to the phosphor to permit arc tube 20 to provide the desired operating temperature for the phosphor.

The Figure also illustrates the construction of arc tube 20 which preferably comprises a gas-tight ultraviolet transmissive arc tube 20 having electrodes 24 disposed at either end thereof. Electrodes 24 may comprise enlargements of the ends of electrode leads extending into arc tube 20. In order to provide a gas-tight seal, a portion of leads 18 and 19 may comprise metal foil strip 21 comprising a metal, is specifically chosen to form a gas-tight adhesive bond to the glass of arc tube 20 and electrical connection to the metal of the electrode leads. Such foil typically comprises molybdenum.

A significant aspect of the present invention which is related to the production of the proper wavelength ultraviolet radiation is the inclusion within arc tube 20 of an appropriate amount of a vaporizable discharge medium. For example, this medium may be disposed within arc tube 20 as pellet 30. In accordance with one preferred embodiment of the present invention, the discharge medium comprises either copper halide, rhenium halide, magnesium halide or silver halide. However, copper halide is the preferred choice since rhenium and silver are not as easy to work with in their halide forms. However, either copper bromide or copper iodide may be employed to produce the desired ultraviolet output from arc tube 20. Copper from the halides exhibits a strong and efficient output at near ultraviolet wavelengths of 327.4 and 324.7 nanometers. Furthermore, even though their halides may be difficult to work with, both rhenium and silver exhibit ultraviolet radiation at appropriate wavelengths and may be employed in the lamp of the present invention. In particular, rhenium exhibits ultraviolet radiation having a wavelength of 346.5 nanometers. Likewise, silver exhibits ultraviolet radiation at a wavelength of 328 nanometers. Magnesium has been suggested in the past as a radiating species. Magnesium has a strong resonance line at 285.2 nanometers, but this radiation is absorbed by many plastics and glasses making it less desirable for use in the present invention.

For example, if copper iodide is employed in pellet 30, and if the lamp is operated at the reservoir temperature between approximately 500° C. and approximately 900° C., the copper iodide exhibits respectively correspondingly vapor pressures of between approximately 1 and approximately 100 torr. However, the preferred operating temperature of the present lamp is approximately 600° C. At this temperature, an arc tube comprising relatively expensive fused quartz is not required and a less expensive, hard glass may be used for arc tube 20. Additionally, it is also desirable to add small amounts of argon or other noble gas to arc tube 20 for the purpose of facilitating lamp starting. However, such noble gases may be added for other purposes in amounts which vary according to the function desired. Optionally, mercury may be added to obtain desired electrical characteristics. Mercury is added to produce a partial pressure of from about 1 to about 20 atmospheres at operating temperatures.

A significant advantage to be noted in the fluorescent arc lamp shown in the Figure is the fact that the phosphor is isolated from the discharge. As opposed to conventional fluorescent lamps, the environment for the phosphor, the vacuum and the inert gas can be selected independently, thereby eliminating phosphor deterioration due to the presence of mercury atoms or ions, electrons, or short wavelength ultraviolet radiation.

In one embodiment of the present invention, phosphor material is embedded in plastic or low melting point glass which is, in turn, used as the outer jacket or envelope 40 of lamp 10. In another embodiment of the present invention, the phosphor comprises organic phosphors which are dissolved, rather than embedded, in the plastic material. In both cases, the resultant outer envelope acts as an optically homogeneous medium. The present invention also includes the use of alternating layers of phosphor and plastic materials. Insofar as the phosphor-containing shell is optically clear and homogeneous, a significant fraction of the radiation emitted is trapped by total or partial internal reflection of the surfaces of the layers. For instance, in a solid with index of refraction n−1.54 the critical angle is 41° and, thus, 25% of the isotropically-emitted radiation is totally internally reflected. In the case of the embedded particulate phosphor, it is desirable to employ phosphor in plastic materials having a slight mismatch between the index refraction of the phosphor and that of the embedding medium. This slight mismatch permits a greater amount of visible wavelength radiation to escape but does not significantly increase multiple internal reflections. In the embodiments in which organic phosphors are dissolved in a solid plastic solution, an effect similar to slight mismatch of the indices of refraction is obtained by embedding scattering particles in the plastic material. In both cases, a certain fraction of the light is still scattered back into the interior of the lamp where some of it is lost by absorption. However, additional modification can still be made to further optimize the escape of light from the lamp. In particular, the outer surface of shell 40 may be roughened or configured to have a roughened surface. Roughening may be accomplished by sand blasting or grinding, machining, molding or casting. Thus, escape of light is assisted by forming a multiplicity of prismatic-shaped surfaces on the exterior surface of shell 40, these surfaces not being parallel to the inner surface of shell 40. It is nonetheless desirable to have the inner surface optically smooth to inhibit, so far as possible, return of emitted visible wavelength radiation to the interior of the lamp where it may be absorbed. However, the outer surface preferably possesses an irregular texture.

FIG. 2 shows a cross section of a portion of shell 40 more particularly being hatched to indicate that phosphor particles may be embedded in a low melting point glass. In the case of a close matching of indices of refraction for the glass and the phosphor, FIG. 2 is also illustrative of the fact that light scattering particles may also be included. FIG. 3 shows a cross section of a portion of shell 40 more particularly being hatched to indicate the situation in which an organic phosphor is in solution with a plastic material. In this case, separate species are not present. However, in all embodiments of the present invention, shell 40 is characterized by being substantially optically homogeneous and containing phosphor for absorbing incident UV and reradiating at a different frequency.

From the above it may be appreciated that the present invention provides an efficient fluorescent lamp which is optically optimized for the production and radiation of visible wavelength radiation. It is further seen that the lamp of the present invention is made possible by the use of ultraviolet sources emitting radiation in the near ultraviolet region.

While the invention has been described in detail herein in accord with certain preferred embodiments thereof, many modifications and changes therein may be effected by those skilled in the art. Accordingly, it is intended by the appended claims to cover all such modifications and changes as fall within the true spirit and scope of the invention.

The invention claimed is:

1. A fluorescent lamp comprising:

a source of near ultraviolet radiation having a wavelength of between approximately 280 and approximately 350 nanometers comprising an evacuable ultraviolet light-transmissive envelope having electrodes disposed at either end thereof and containing therein an ionizable medium including a halide selected from the group consisting of copper halide, magnesium halide, rhenium halide, and silver halide; and a shell at least partially surrounding said ultraviolet source, said shell comprising a material transmissive to visible radiation, and to ultraviolet radiation having a wavelength between approximately 280 and approximately 400 nanometers, said shell being substantially optically homogenous and containing at least one phosphor for absorbing said ultraviolet radiation and reradiating light at different frequencies, said shell having embedded therein at least one phosphor having an index of refraction selected to be slightly different from the index of refraction of said shell.

2. The lamp of claim 1 in which the outer surface of said shell possesses an irregular texture.

3. A fluorescent lamp comprising:

a source of near ultraviolet radiation having a wavelength of between approximately 280 and approximately 350 nanometers comprising an evacuable ultraviolet light-transmissive envelope having electrodes disposed at either end thereof and containing therein an ionizable medium including a halide selected from the group consisting of copper halide, magnesium halide, rhenium halide, and silver halide; and a plastic shell at least partially surrounding said ultraviolet source, said shell comprising a material transmissive to visible radiation, and to ultraviolet radiation having a wavelength between approximately 280 and approximately 400 nanometers, said shell being substantially optically homogenous and containing at least one organic phosphor for absorbing said ultraviolet radiation and reradiating light at different frequencies dissolved in said shell, the outer surface of said shell possessing an irregular texture to optimize escape of light from the lamp.

* * * * *